US011266873B1

(12) United States Patent
Sherman et al.

(10) Patent No.: US 11,266,873 B1
(45) Date of Patent: Mar. 8, 2022

(54) BICYCLE-TYPE EXERCISE APPARATUS

(71) Applicants: Stacy Sherman, Los Angeles, CA (US); Gershon Parent, Olalla, WA (US)

(72) Inventors: Stacy Sherman, Los Angeles, CA (US); Gershon Parent, Olalla, WA (US)

( * ) Notice: Subject to any disclaimer, the term of this patent is extended or adjusted under 35 U.S.C. 154(b) by 15 days.

(21) Appl. No.: 16/857,063

(22) Filed: Apr. 23, 2020

Related U.S. Application Data

(60) Provisional application No. 62/839,138, filed on Apr. 26, 2019.

(51) Int. Cl.
*A63B 22/06* (2006.01)
*A63B 21/00* (2006.01)
*A63B 21/16* (2006.01)

(52) U.S. Cl.
CPC .... *A63B 22/0605* (2013.01); *A63B 21/00069* (2013.01); *A63B 21/1609* (2015.10); *A63B 21/4034* (2015.10); *A63B 22/0694* (2013.01); *A63B 2022/0611* (2013.01); *A63B 2210/50* (2013.01); *A63B 2225/685* (2013.01)

(58) Field of Classification Search
CPC ..... A61B 22/0605; A61B 21/4034; A61B 22/0694; A61B 21/00069; A61B 21/1609; A61B 2225/685; A61B 2210/50; A61B 2022/0611
See application file for complete search history.

(56) References Cited

U.S. PATENT DOCUMENTS 3,100,640 A * 8/1963 Weitzel ..... A63B 22/0694 482/60
4,961,571 A * 10/1990 Lin ..... A63B 22/0012 482/57

(Continued)

FOREIGN PATENT DOCUMENTS

AU 2009200553 A 8/2009
CN 108619664 A 10/2018

(Continued)

OTHER PUBLICATIONS https://www.amazon.com/Daiwa-Felicity-Foldable-Exercise-Adjustable/dp/B0785ND1Y5/ref=pd_di_sccai_2/133-7552917-6720302?pd_rd_w=snNvg&pf_rd_p=c9443270-b914-4430-a90b-72e3e7e784e0&pf_rd_r=N5TSS2MET6BZAEKQX18B&pd_rd_r=cc8d6422-aef8-4673-8866-36915086374b&pd_rd_wg=6bZ3Q&pd_rd_i=B0785ND1Y5&psc=1; Date: Mar. 28, 2018.*
Oxford Languages ; Ring Definition; Date: Jul. 1, 2021.*
https://www.youtube.com/watch?v=mM_DYu4o58Y; QVCtv Square Bike Space-Saving Stationary Bike; Date: Jan. 14, 2018.*

(Continued)

*Primary Examiner* — Andrew S Lo
*Assistant Examiner* — Andrew M Kobylarz
(74) *Attorney, Agent, or Firm* — Kenneth H. Ohriner; Perkins Coie LLP

(57) ABSTRACT

An exercise apparatus includes a ring rotatably supported within a frame. First and second pedals are supported on first and second pedal shafts, and each pedal shaft is pivotally attached to the ring. Each pedal may be pivotal from a folded position wherein the pedal shaft lies on a radius of the ring, to a deployed position wherein the pedal shaft is perpendicular to a plane defined by the ring. Each pedal has a lock out device for holding the pedal in the unfolded position. The apparatus has no central hub or axle. Foldable or removable legs or supports, if used, may be attachable to the frame, or made part of the frame, for holding the frame in an upright position when the apparatus is in use. The exercise apparatus is compact and lightweight.

20 Claims, 15 Drawing Sheets

(56) References Cited

U.S. PATENT DOCUMENTS

| | | | | |
|---|---|---|---|---|
| 5,108,092 | A * | 4/1992 | Hurst | A63B 22/0005 482/60 |
| 5,314,392 | A | 5/1994 | Hawkins et al. | |
| 5,490,824 | A * | 2/1996 | Wang | A63B 22/0007 482/119 |
| 5,860,941 | A | 1/1999 | Saringer et al. | |
| 7,163,491 | B2 | 1/2007 | Rufino | |
| 9,278,251 | B2 | 3/2016 | Decca | |
| 9,403,053 | B2 | 8/2016 | Kaiser et al. | |
| D778,997 | S | 2/2017 | Xu | |
| 9,889,335 | B2 | 2/2018 | Palmer | |
| 9,889,337 | B2 | 2/2018 | Palmer | |
| 10,118,072 | B2 | 11/2018 | Palmer | |
| 2003/0228961 | A1 | 12/2003 | Huang | |
| 2018/0236290 | A1* | 8/2018 | Andersen | A63B 21/0051 |

FOREIGN PATENT DOCUMENTS

| | | | |
|---|---|---|---|
| DE | 8519150 | U1 | 10/1985 |
| GB | 2538108 | A | 5/2016 |
| KR | 20020096790 | A | 12/2002 |
| KR | 200440357 | Y1 | 4/2007 |
| TW | M500594 | Y | 5/2015 |
| TW | M559729 | Y | 5/2018 |
| WO | 2018194468 | A2 | 10/2018 |

OTHER PUBLICATIONS

Therapy Trainer, "TherapyTrainerTherapyCycle" accessed Apr. 3, 2019 at https://www.therapytrainer.com/pages/therapytrainer-com-therapycycle. 6 pages.

U.S. Jaclean, "Square Bike—USJ-875" accessed Apr. 3, 2019 at https://www.usjaclean.com/fitness/square-bike. 4 pages.

* cited by examiner

BICYCLE-TYPE EXERCISE APPARATUS

CROSS-REFERENCE TO RELATED APPLICATIONS

This application claims the benefit of U.S. Provisional Patent Application No. 62/839,138, filed Apr. 29, 2019, which is incorporated herein by reference in its entirety.

BACKGROUND OF THE INVENTION

The field of the invention is exercise apparatus, and in particular a simple, lightweight and highly compact and portable bicycle-type exercise apparatus.

It is well known that regular exercise improves overall health and fitness. Medical research continues to find a direct relationship between physical activity and health. Aerobic exercises such as cycling are known to provide a conditioning effect and to improve overall health and cardiovascular performance. Unfortunately, many people have difficulty exercising consistently.

Many bicycle-type exercise apparatus have been known and used in the past. Typically, these types of apparatus have a bicycle type frame and seat, and simulate pedaling a bicycle. Although these types of apparatus have advantages, they are too large and heavy to be easily stored or transported for everyday use. More compact bicycle-type apparatus have also been provided, by eliminating the bicycle-type frame and seat entirely, and using essentially only a set of pedals attached to cranks on an axle, along with a braking mechanism to adjust resistance. Although these types of apparatus have met with vary degrees of success, there remains a need for an improved bicycle-type exercise apparatus which is highly compact, lightweight and portable.

SUMMARY OF THE INVENTION

An exercise apparatus includes a ring rotatably supported within a frame. First and second pedals are supported on first and second pedal shafts, and each pedal shaft is pivotally attached to the ring. Each pedal may be pivotal from a folded position wherein the pedal shaft lies on a radius of the ring, to a deployed position wherein the pedal shaft is perpendicular to a plane defined by the ring. The apparatus has no central hub or axle. The pedal positions are offset from a center of the ring. The pedals may be within the envelope of the frame when the pedals are in the folded position. Foldable or removable legs or supports, if used, may be attachable to the frame, or made part of the frame, for holding the frame in an upright position when the apparatus is in use.

The apparatus is simple in design and use, highly lightweight and compact, and may be easily carried and stored. The apparatus can fit into a backpack or luggage for use when travelling.

BRIEF DESCRIPTION OF THE DRAWINGS

In the drawings, the same reference number indicates the same element in each of the views.

DETAILED DESCRIPTION OF THE DRAWINGS

Figure 2:
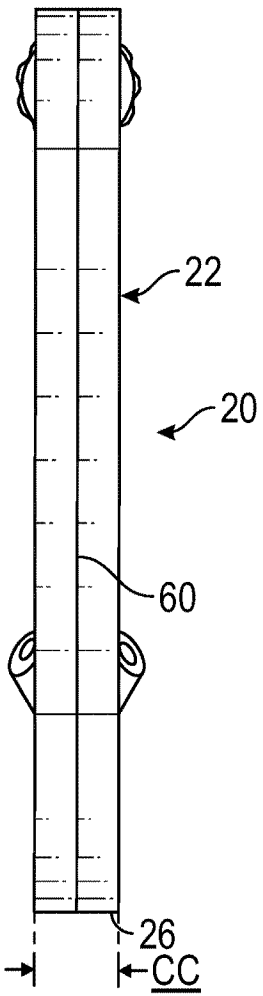
FIG. 2 is a rear view of the apparatus as shown FIG. 1.
Figure 1:
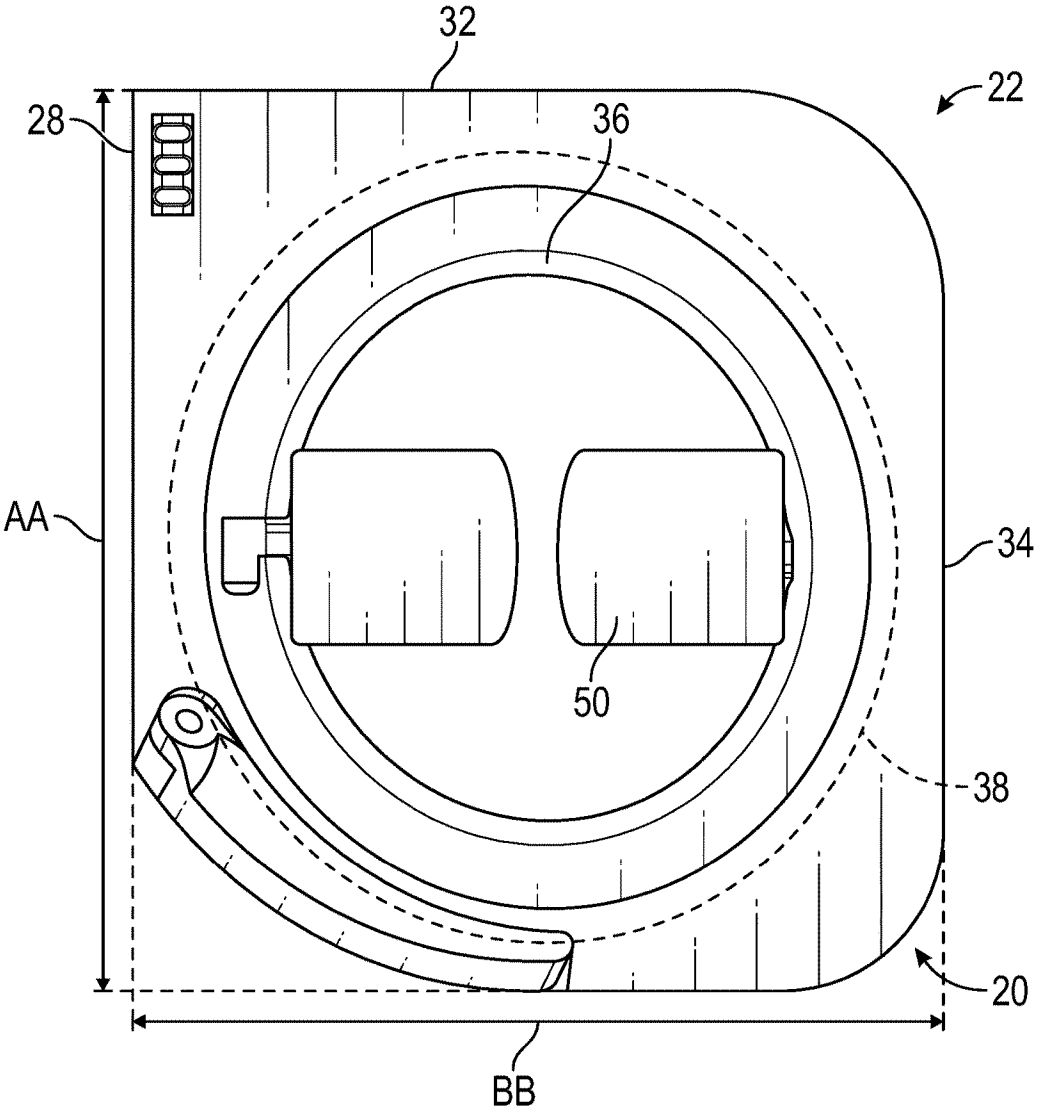
FIG. 1 is a left side view of a bicycle-type exercise device or apparatus, wherein the pedals and support legs are in the folded or storage position.

As shown in FIGS. 1-4, a cycling exercise apparatus 20 includes a ring 36 rotatably mounted within a frame 22. The frame may have a width CC of 2 to 8, or 3 to 7 cm, as shown in FIG. 2. As shown in FIG. 1, the frame may have a height AA and a length BB of about 30 to 40 cm. The ring has an inner diameter DD shown in FIG. 5 of about 18 to 28 centimeters, which generally will vary depending on the preferred dimensions of the frame 22.

Figure 11:
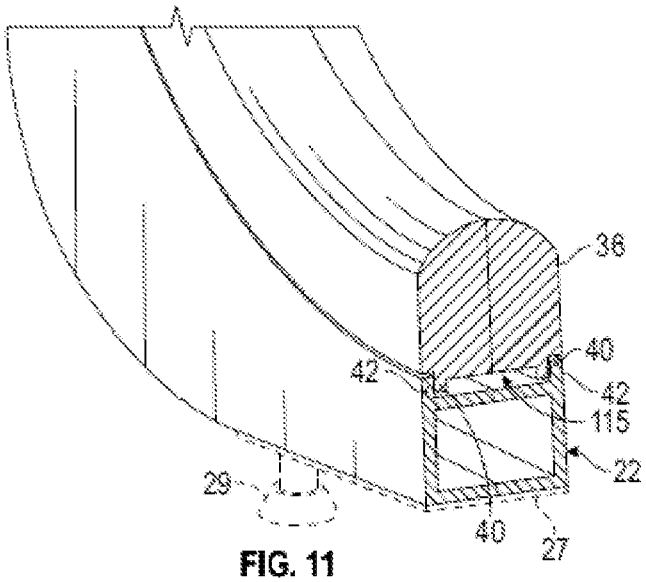
FIG. 11 is an enlarged perspective section view of the apparatus shown in FIGS. 1-8.

The frame may be generally square, optionally with rounded corners transitioning from the front surface 28 of the frame 22 to the bottom surface 26. The rear corners transitioning from the top surface 32 of the frame 22 to the back surface 34 of the frame 22, and from the bottom surface 26 to the back surface 34 may also be rounded. In the embodiment of FIGS. 1-4, the left and right sides of the frame 22 and the front surface 28, top surface 32, back surface 34 and bottom surface 26 may be flat. However, other configurations may be used. For example, the frame 22 may optionally be generally circular. The bottom surface 26 may be flat so that the apparatus 20 may be better supported on a flat floor surface when in use, with or without use of frame legs or other support. Referring momentarily to FIG. 11, the bottom surface 26 may have a grip element 27 to resist slipping on a floor. The grip element 27 may be provided as a textured surface, projections, a rubber strip, or a Velcro®-like (hook and loop tape) material, to resist movement on carpeting. Rubber feet 29 may optionally be attachable to the bottom surface 26 for use on hard surfaces.

The frame 22 may be manufactured from plastic, metal, fiberglass, or other relatively high strength and lightweight material. The frame 22 may have clamshell design, with largely mirror image left and right sides adjoining each other along a central parting line 60 shown in FIG. 4, and with the left and right sides of the frame attached to each other via fasteners, snap-in elements such as pegs, adhesives, etc. Equivalently, the frame may be manufactured with top and bottom sections.

Figure 9:
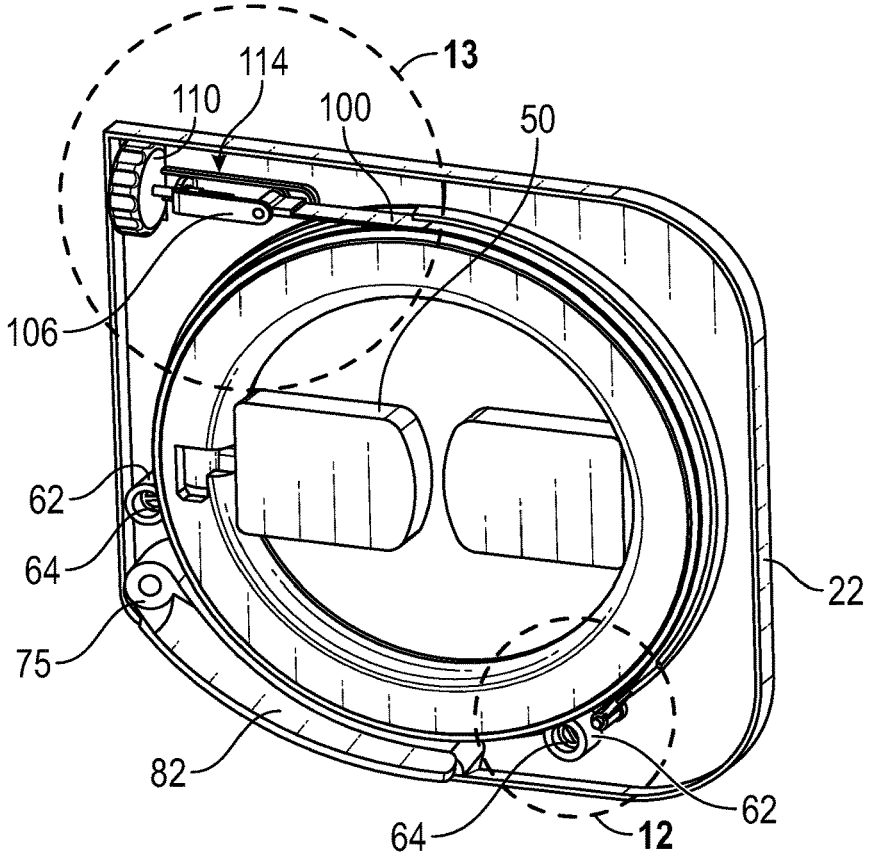
FIG. 9 is an interior view of the apparatus of FIGS. 1-8.
Figure 12:
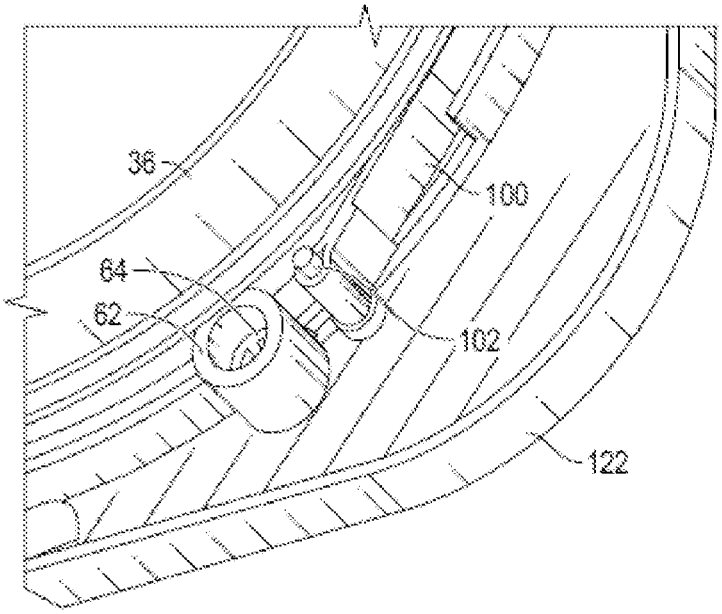
FIG. 12 is an enlarged perspective view of detail AA in FIG. 9.

The ring 36 may have a similar construction. As shown in FIGS. 9 and 12 the ring 36 is rotatably supported within the frame 22 on roller bearings 62 supported on roller posts 64. The embodiment shown uses two roller bearings 62, additional roller bearings may be used. As shown in FIG. 11, in the embodiment of FIGS. 1-8, the ring 36 has first and second spaced apart rims 40 positioned between first and second flanges 42 on the frame 22, to retain the ring 36 in alignment within the frame.

Alternatively, the ring 36 may be rotatably supported on or in the frame 22 via a single ring bearing 38 shown in dotted lines in FIG. 1. The ring bearing 38, if used, may be a continuous or segmented low friction material. In some embodiments, depending on the materials used, no bearing may be used or needed and a lubricant alone allows the ring to rotate within the frame with minimal friction. For example, the ring 90 shown in the embodiment of FIG. 18 may have a film of light oil between the concave outer surface 92 of the ring and the convex inner adjoining surface 94 of the frame. In another embodiment, the ring 36 may have a generally C-shape or U-shape, with the ring having flanges which overlay the sides of the frame 22.

Figure 10:
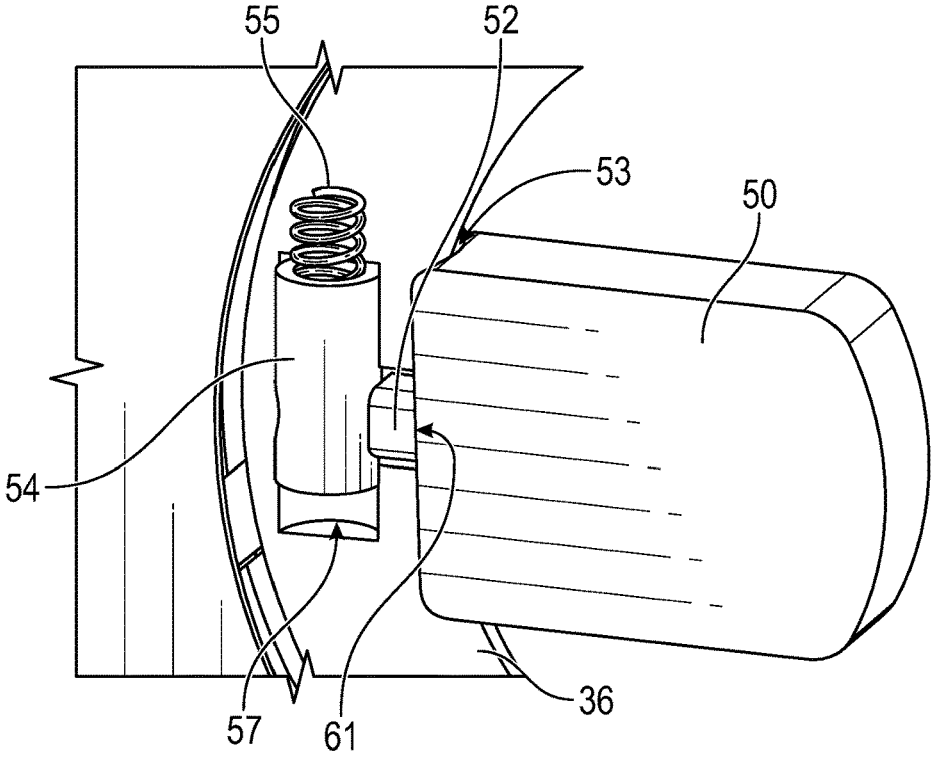
FIG. 10 is an enlarged partially exploded perspective view of one of the pedals in the folded position.
Figure 14:
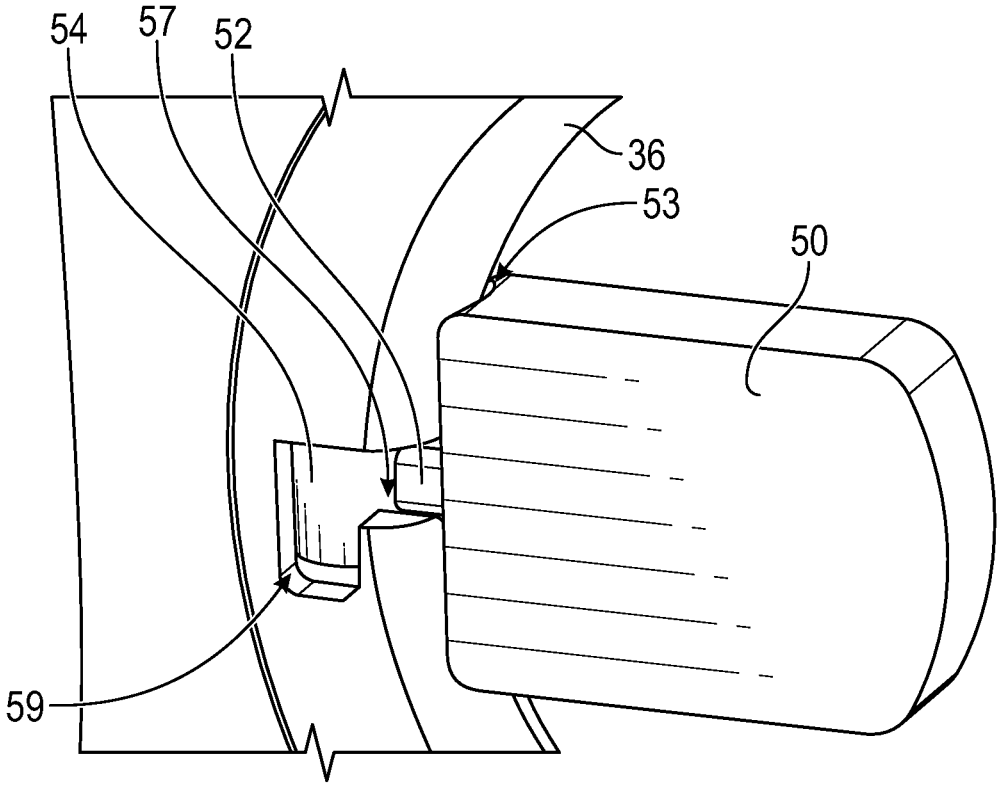
FIG. 14 is an enlarged schematic view of the pedal lockout shown in FIGS. 10 and 14 with the pedal in the folded or storage position.

Referring once again to FIGS. 1-4, left and right side pedals 50 are attached onto opposite sides of the ring 36. The pedals 50 are pivotable between the folded position shown in FIGS. 1-4, and the unfolded or deployed position shown in FIGS. 5-8. Various techniques may be used to attach the pedals 50 to the ring 36 providing the folded and deployed positions. As shown in FIGS. 10 and 14, in the embodiment described above, each pedal 50 is rotatably attached to a pedal shaft 52. Each of the first and second pedal shafts 52 is rigidly attached to a pivot axle 54. The pivot axle 54 is pivotally mounted on or in a recess in the ring 36 and can pivot 90 degrees between folded and deployed positions. Alternatively each pedal may be rigidly attached to the pedal shaft with the pedal shaft rotatably attached to the pivot axle 54. As shown in FIG. 9 the pivot axles 54 are aligned on radii RR of the ring 36 and in the folded position the pedals may be centered on a common diameter.

As shown in FIG. 14, the recess may be provided in the form of an L-shaped slot. With the pedal 50 in the folded position, the pedal shaft 52 extends radially inwardly from the pivot axle 54 through a radial opening or portion 57 of the L-shaped slot. With the pedal in the unfolded position, the pedal shaft 52 extends outwardly to the side from the pivot axle 54 through a side opening or portion 59 of the L-shaped slot.

The apparatus includes a pedal lock out to hold the pedals into the deployed position during the entire rotation of the ring. This prevents the pedals from pivoting back into the folded or storage position during pedaling when the apparatus is in use. As the ring 36 rotates and each pedal sequentially moves into the sector closest to the user, the force exerted on the pedal by the user acts in the direction tending to push the pedal into the folded position. The pedal lock out holds the pedal in the deployed position against this folding force.

Figure 15:
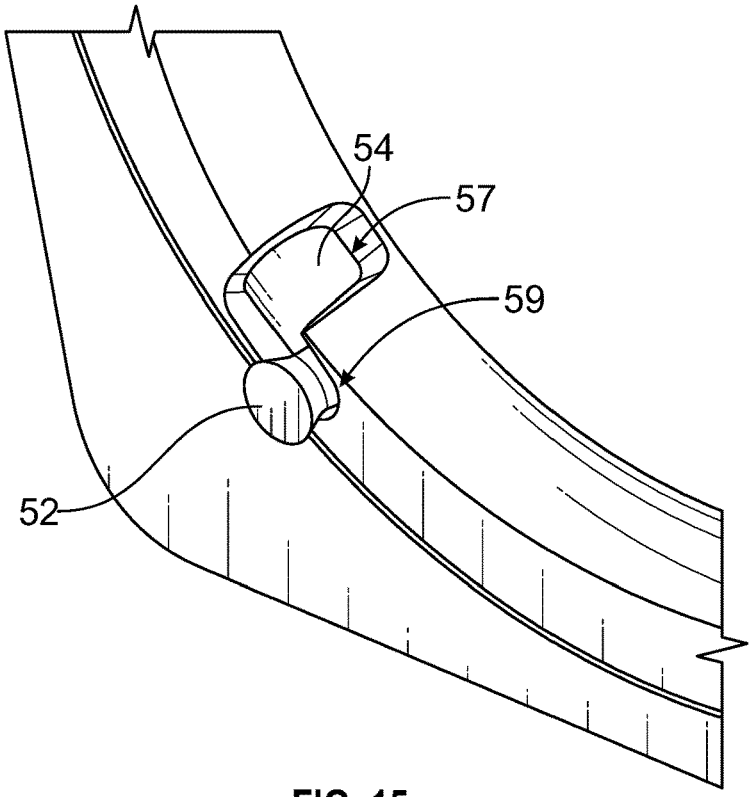
FIG. 15 is an enlarged schematic view of the pedal lockout shown in FIGS. 10 and 14 with the pedal shaft in the deployed position, and the pedal omitted for purpose of illustration.

Referring to FIGS. 10 and 14, with the pedal 50 in the folded position, a spring 55 urges the pivot axle downward in FIG. 14 which shows the left pedal. This holds the pedal shaft 52 into a notch 61 in the ring 36. The pedal consequently remains in the folded position unless it is pulled into the unfolded position with force sufficient to overcome the holding force of the spring 55. Similarly, with the pedal in the unfolded position shown in FIG. 15, the spring 55 holds the pedal shaft 52 against the bottom of the side opening 59. The pedal 50 consequently remains in the unfolded position unless the pivot axle is lift up, against the force of the spring, and pivoted into the folded position. In an alternative design, the spring may be omitted and a pin, detent, friction fit or lever may be used to hold each pedal into the deployed position.

As shown also in FIGS. 10 and 14, each pedal 50 may have a groove 53 in one or both outer corners of the pedal, or along the entire outer surface of the pedal. The groove 53 may match the contour of the inner facing surface of the ring 36, optionally with groove moving over the ring with a snap fit engagement. This keeps the pedal 50 from rotating on the pedal shaft 52 when in the folded position. Alternatively, the outer surface or end of the pedal 50 may be made of a compressible or resilient material, for preventing rotation of the pedal when in the folded position via friction and/or compression force of the material against the inner surface of the ring 36.

Figure 5:
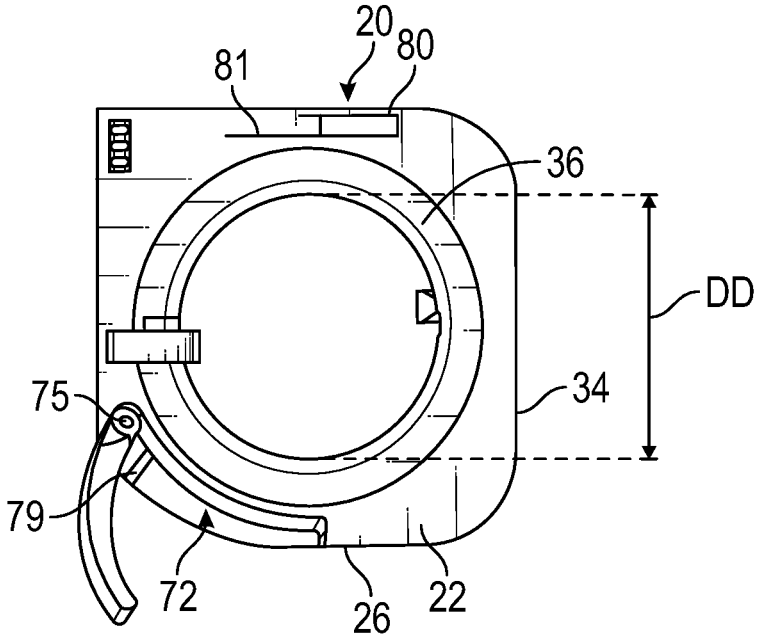
FIG. 5 is a left side view of the apparatus of FIG. 1 wherein the pedals and support legs are in the deployed position.
Figure 6:
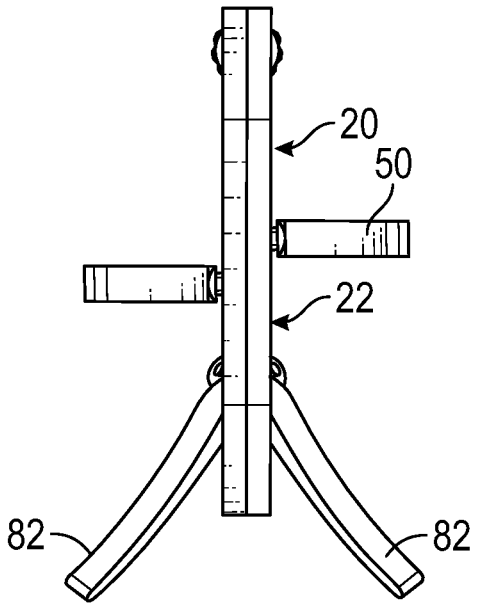
FIG. 6 is a rear view of the apparatus as shown in FIG. 5.

Referring once again to FIGS. 1-8, the cycle apparatus 20 may have fold-out legs 82 pivotally attached on opposite sides of the frame 22, at hinges 75 at the bottom front corner of the frame 22. The frame 22 may have recesses 72 to allow the legs 82 to fold generally flush with the frame. As shown in FIG. 5, the hinges 75 or the legs 82 may have snap or lock elements 79, such as spring clips, detents, etc. to hold the legs 82 into the recesses 72, or into the deployed position. As shown in FIG. 5 the legs 82 may be curved on a radius extending from the center of ring 36. The recesses 72, if used, may have a corresponding shape and size, so that the legs can fit substantially or entirely within the width of the frame 22, as shown in FIG. 2. When unfolded, the legs 82 hold the front of the frame 22 up off of the floor, providing tripod-type support.

Figure 18:
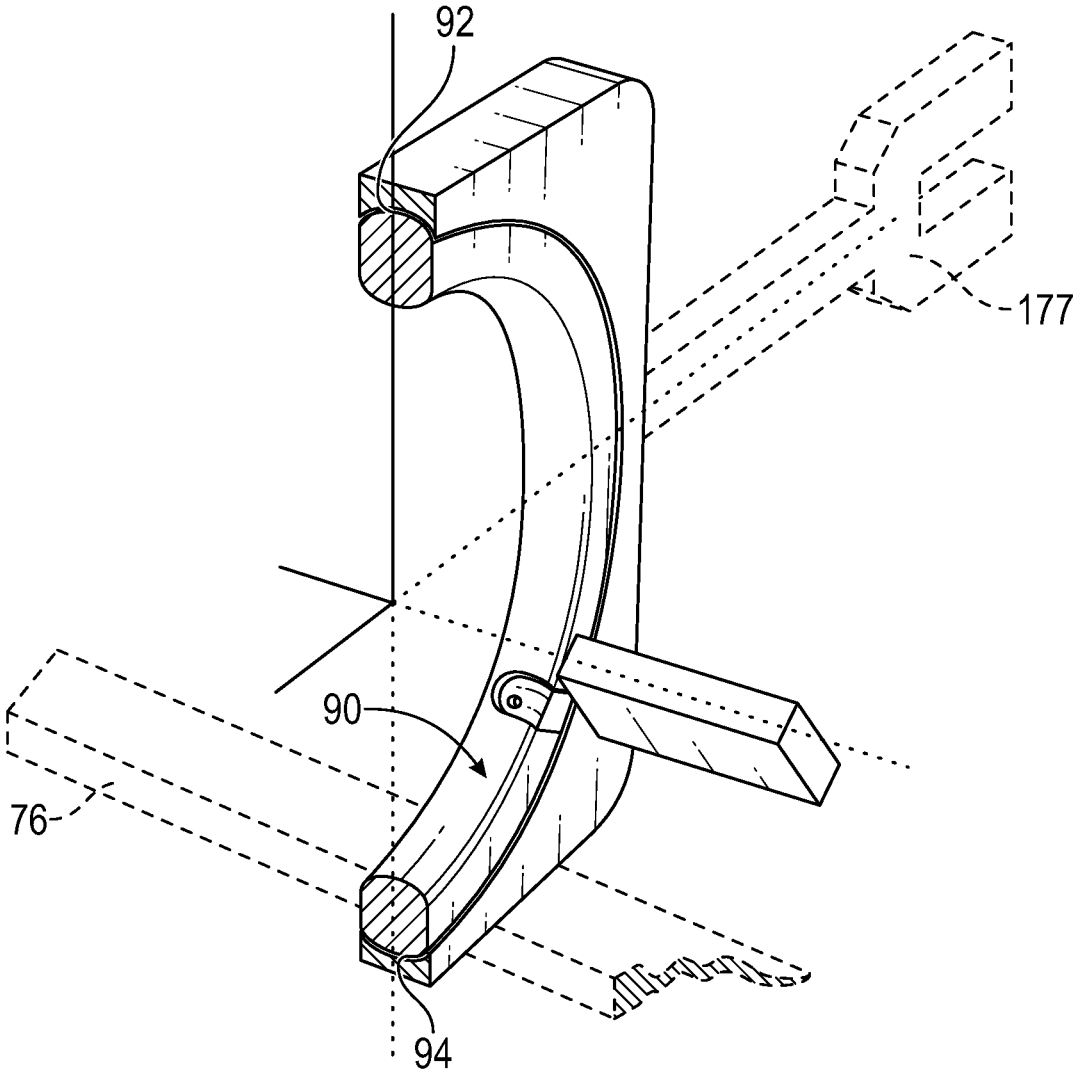
FIG. 18 is a perspective section view of an alternative embodiment.

In an alternative design, the fold-out legs 82 may be omitted and the apparatus used without any legs or other support. Alternatively, the frame 22 may be supported using one or more cross-bar legs 76 as shown in FIG. 18. The legs 76 may be attached to the frame 22 via snap-in or screw-on fittings, to allow the legs 76 to be removed from the apparatus 20 when not in use. Alternatively the legs 76 may be pivotally attached to the bottom of the fame and pivoted from a storage configuration wherein the legs 76 are parallel to the plane of the frame, to a deployed configuration wherein the legs 76 are perpendicular to the plane of the frame.

Figure 19:
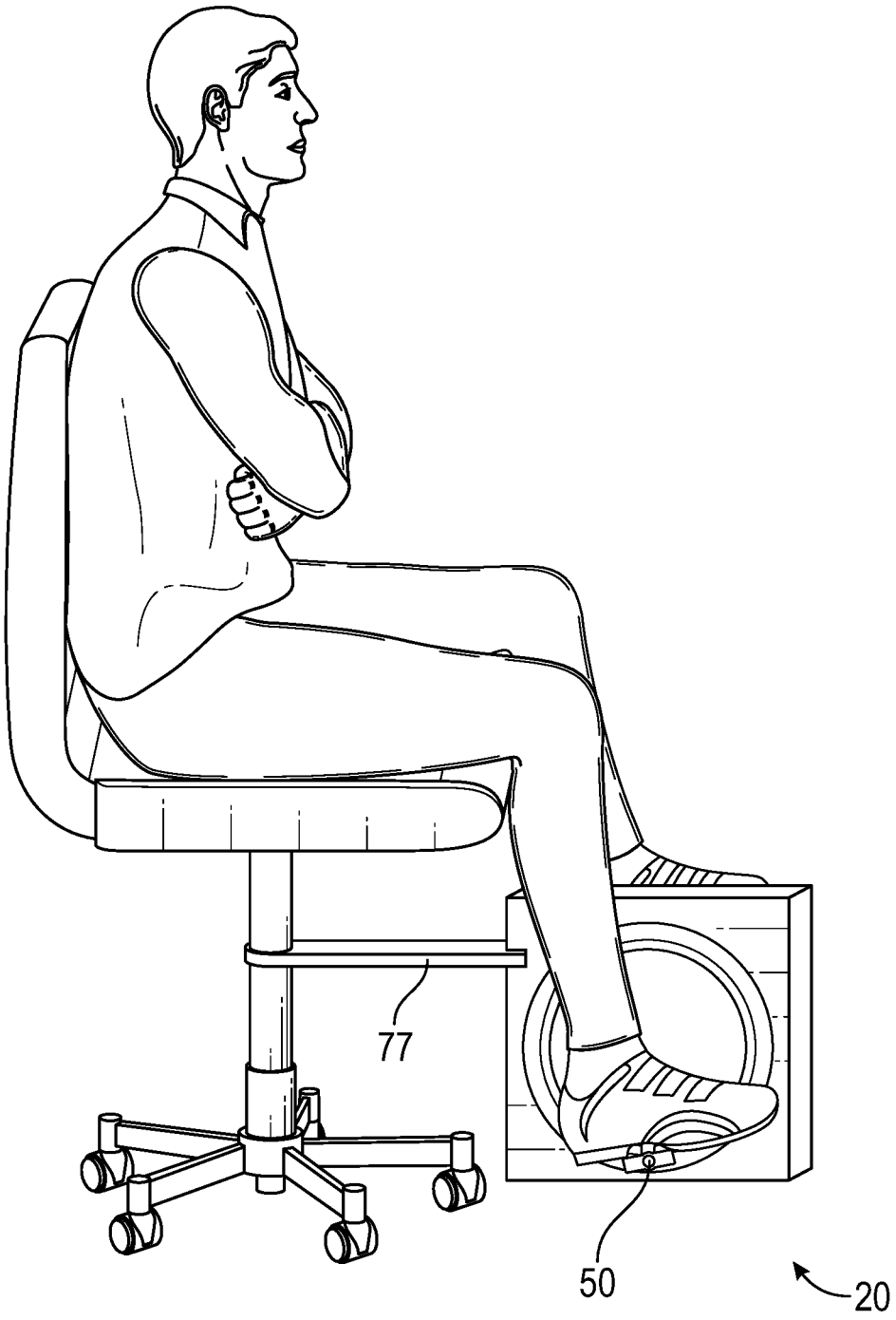
FIG. 19 is a schematic view of the apparatus in use.

As shown in FIG. 18, the frame may optionally have one or more flexible straps or rigid clamp elements 77 for attaching the frame 22 to fixed structure, such as furniture, a door or door frame, etc. for holding the apparatus 20 upright and securely in place during use, with or without having any legs supporting the frame 22. FIG. 19 shows a user seated in a chair with the user's feet on the pedals 50 exercising the legs. In this configuration, the a flexible strap 77 secures the apparatus 20 to the chair. Alternatively, the user may seated on the floor with the user's feet in the pedals for exercising the legs, and with the apparatus 20 also on the floor, optionally with the frame 22 braced against a fixed surface, such as a wall, furniture, etc.

Figure 3:
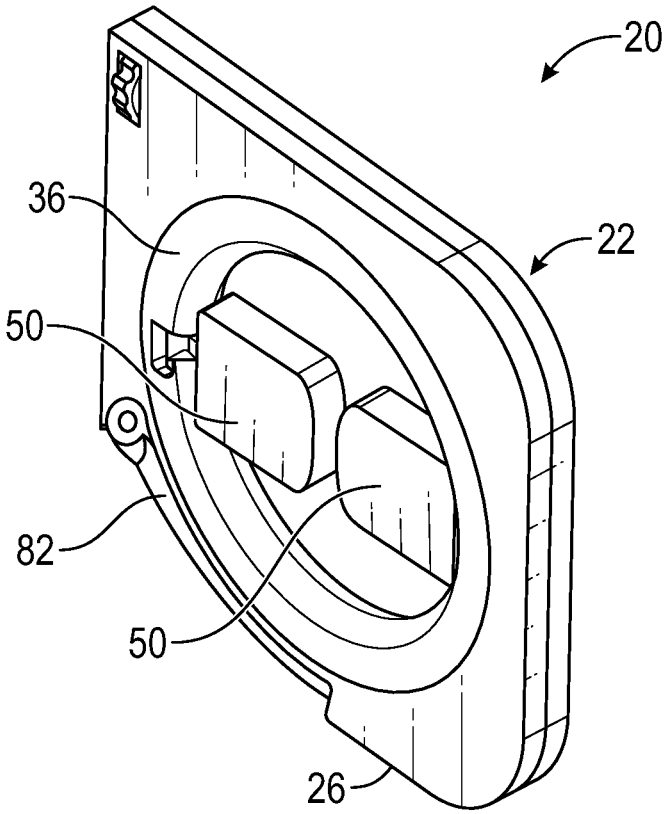
FIG. 3 is a left side perspective view of the apparatus as shown in FIGS. 1 and 2.
Figure 4:
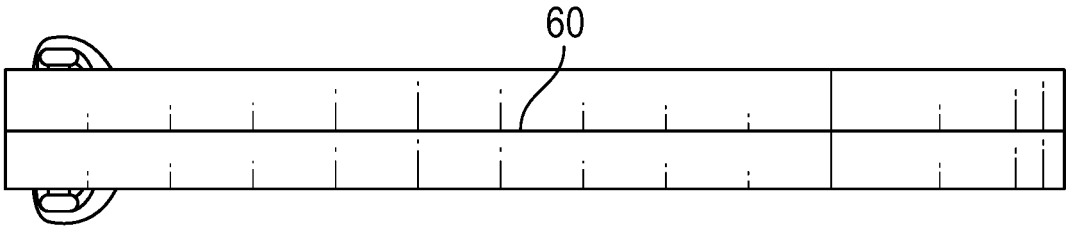
FIG. 4 is a top view of the apparatus as shown in FIGS. 1-3.
Figure 13:
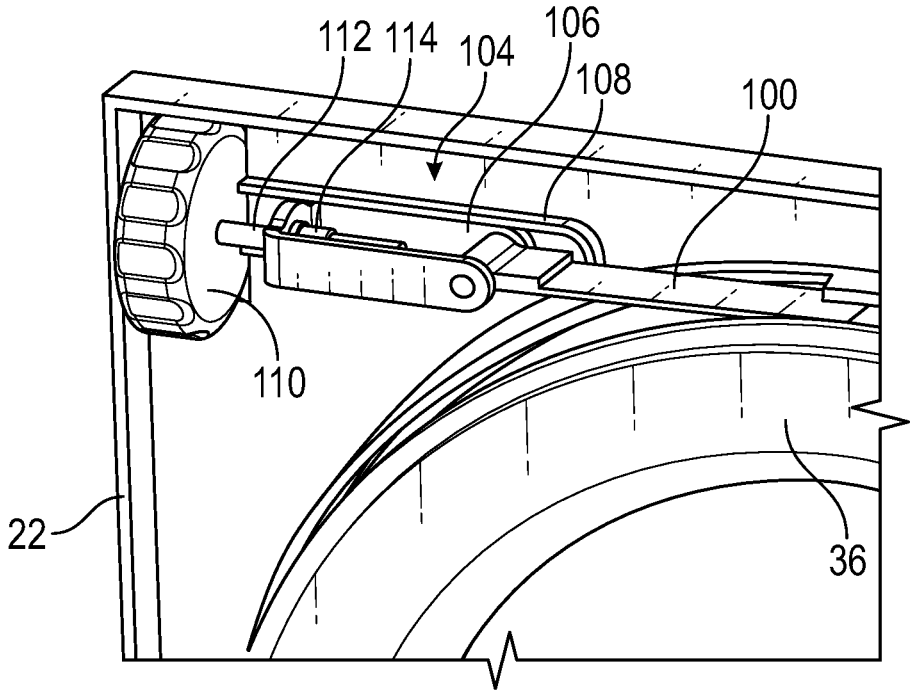
FIG. 13 is an enlarged view of detail BB in FIG. 9.

FIGS. 9, 12 and 13 illustrate one embodiment of an adjustable pedaling resistance device having a strap 100 extending partially around an outside surface of the ring 36. A first end of the strap 100 is attached to the frame 22 adjacent to the rear bottom corner, for example by placing an end loop of the strap over a strap post 102. The other end of the strap 100 is attached to a tensioning device 104 at the top front corner of the frame, which adjusts the tension on the strap 100. In the example shown in FIG. 13, the tensioning device 104 includes a carriage 106 slidable linearly in a guideway 108. An adjuster knob 110 has a threaded rod 112 engaged through a nut 114 on the carriage. The adjuster knob 110 is rotatable but fixed in place on the frame 22, so that rotating the adjuster knob 110 moves the carriage 106 linearly. Tightening the adjuster knob 110 pulls the carriage 106 towards the adjuster knob 110. This increases tension on the strap 100 which increases friction between ring 36 and the strap 100, which increases pedaling resistance. As shown in FIGS. 3 and 13, the sides of the adjuster knob 110 project outwardly through openings in the frame 22 to allow rotation of the adjuster knob.

Referring to FIG. 11, the strap 100 may be positioned in the rectangular space 115 in between the rims 40 to keep the strap 100 aligned on the ring 36. The tensioning device 104 may alternatively be provided as a multiple position lever, cam or spring mechanism.

Figure 17:
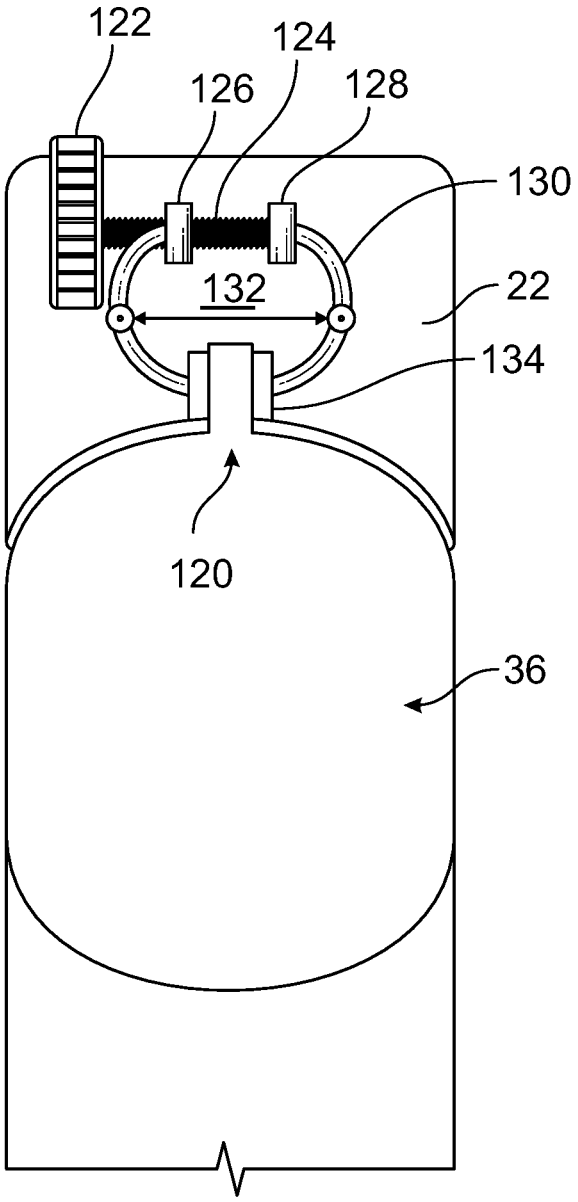
FIG. 17 is a schematic view of an alternative resistance adjusting mechanism.

FIG. 17 shows an alternative adjustable pedaling resistance device wherein a center fin or projection 120 is added entirely around the perimeter of the ring 36. A thumb-wheel 122 extends out of the frame 22 so that it can be rotated to rotate a shaft 124. When the threaded shaft 124 is rotated, a first nut 126 on a left hand threaded section of the shaft 124 is driven towards or away from a second nut 128 on a right hand section of the threaded shaft 124. The nuts 126 and 128 are connected to the first and second lever arms 130 which pivot at hinge points 132, respectively. When the lever arms pivot they cause brake pads 134 to press against the fin 120 to increase or decrease the friction and associated drag on the ring 36. FIGS. 9 and 17 show examples of adjustable pedaling resistance devices having the function of adjusting the pedaling resistance, in these examples by applying a friction force to the ring.

As shown in FIGS. 1, 5 and 9, the inside diameter DD of the ring 36 need only be large enough to accommodate the folded pedals. Clearance between the inner ends of the folded pedals may be for example 4-20 or 5-10 millimeters, allowing the apparatus to be highly compact and lightweight. The pedals may be standard bicycle pedals, with or without toe clips or shoe clips. Alternatively, lighter weight or reduced size pedals may optionally be used. Straps (e.g., made with rubber, fabric or Velcro® hook and loop tape) may be used to hold the user's feet onto the pedals. The pedals may be permanently attached to the ring, or they may be removable by the user to allow different types of pedals or handgrips to be used with the apparatus 20.

Figure 7:
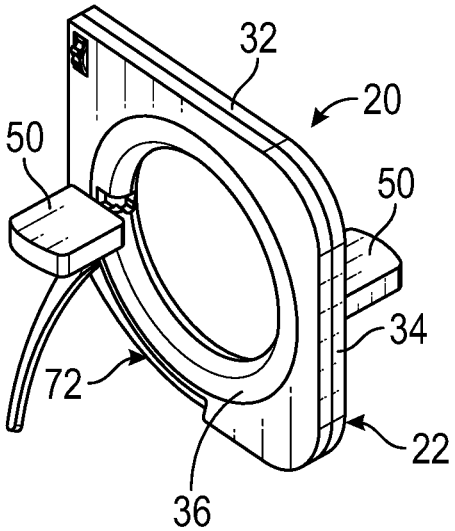
FIG. 7 is a left side perspective view of the apparatus as shown in FIGS. 5 and 6.
Figure 8:
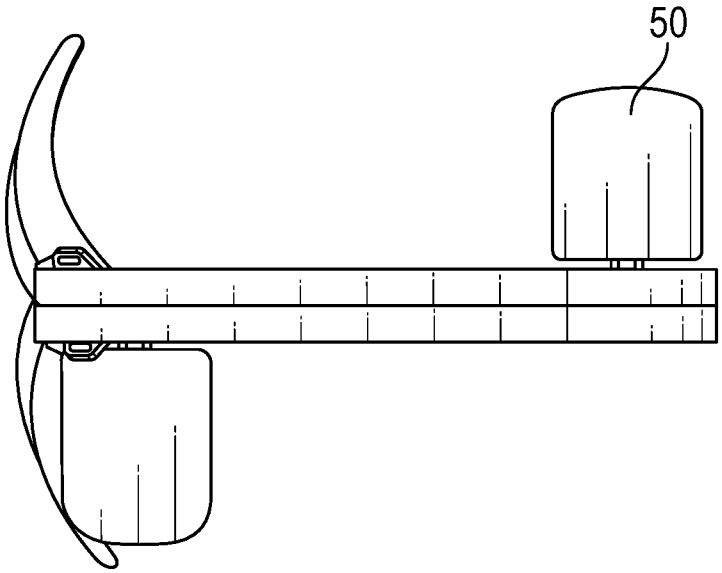
FIG. 8 is a top view of the apparatus shown in FIGS. 5-7.

Unlike conventional cycling exercise apparatus, the present apparatus 20 has no central shaft or central disk, and no cranks connected to the pedals. Rather the pedals are rotatably connected directly to the ring 36. With the pedals deployed, as shown in FIGS. 5 and 7, the area within the ring 36 is entirely open.

Figure 16:
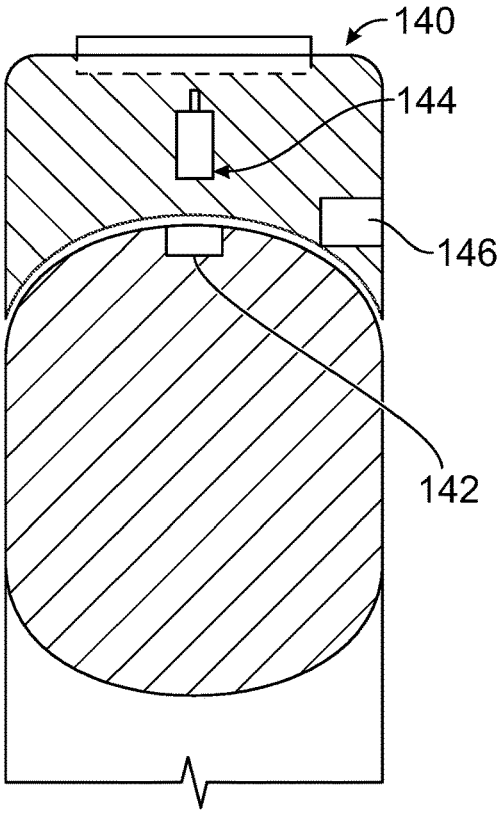
FIG. 16 is a schematic section view of a display and sensor for use with the apparatus of FIGS. 1-8.
Figure 22:
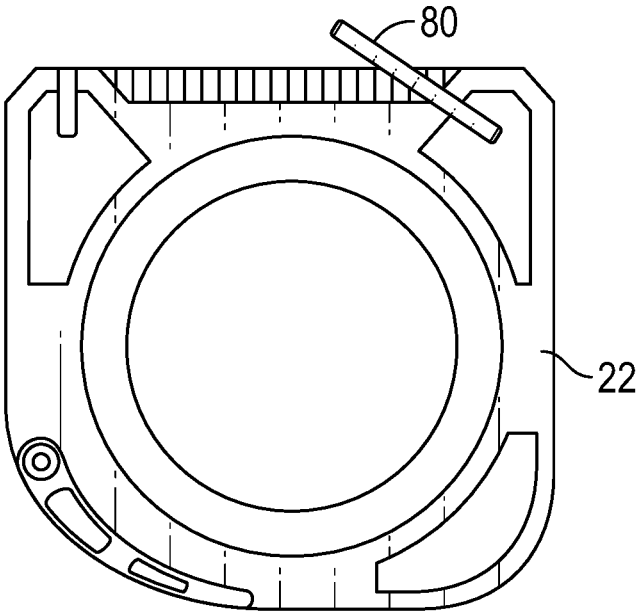
FIG. 22 is a side view of the apparatus of FIGS. 1-4 with a phone on a phone mount.
Figure 23:
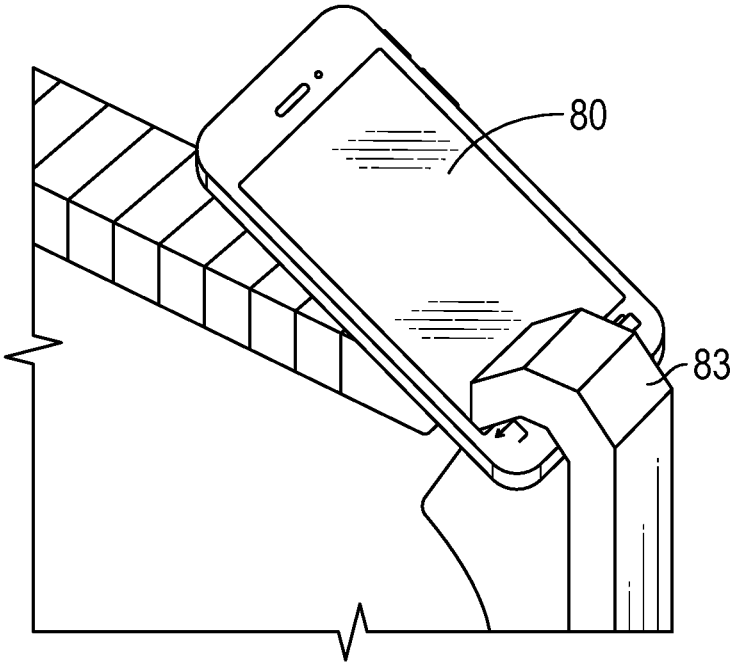
FIG. 23. is a partial perspective view of the phone mount shown in FIG. 22.
Figure 24:
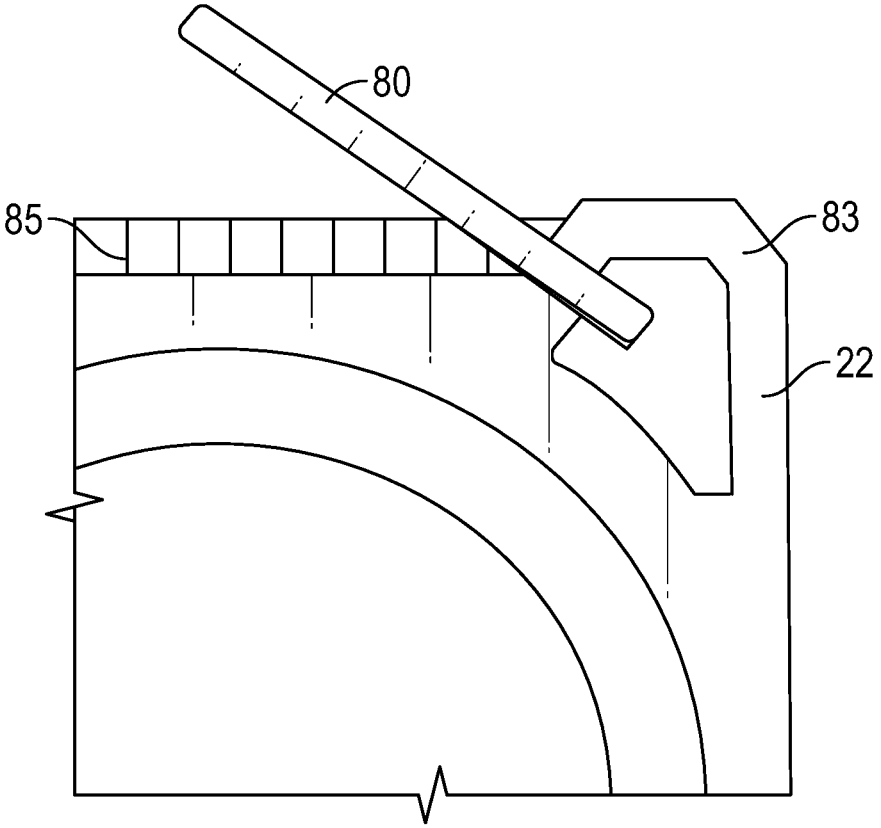
FIG. 24 is an enlarged partial side view of the phone mount shown in FIGS. 22-23.

As shown in FIG. 16, a display 140 may be used on the apparatus to measure and display pedaling speed; power (e.g., calories per hour); time; RPM; and other parameters. A magnet 142 is embedded in the ring, with movement of the magnet past a sensor 144 detected and used in the display. Total energy (e.g., in calories) used over a time interval, or a nominal distance equivalent value, may be calculated using standard formulas. The sensor 144 may optionally be omitted and a mobile phone, tablet or similar device 80 having a built-in magnetometer may be used to detect the motion of the magnet 142. In this embodiment, as shown in FIG. 5, a phone mount 81 may be provided on the frame 22 to hold the user's phone 80. The phone 80 is provided with software for displaying one or more of the parameters listed above. The sensor 144 and related electronics can then be omitted. As shown in FIGS. 22-24, a clip or holder 83 may be attached to or built into the frame 22, at the upper rear corner of the frame, to hold the phone 80. As shown, the holder 83 holds the phone 80 at an angle of about 30 to 45 degrees so that the user can easily view the screen while using the apparatus 20. The angle may be adjustable, optionally via a moveable strut or wedge 85 on the frame.

Figure 20A:
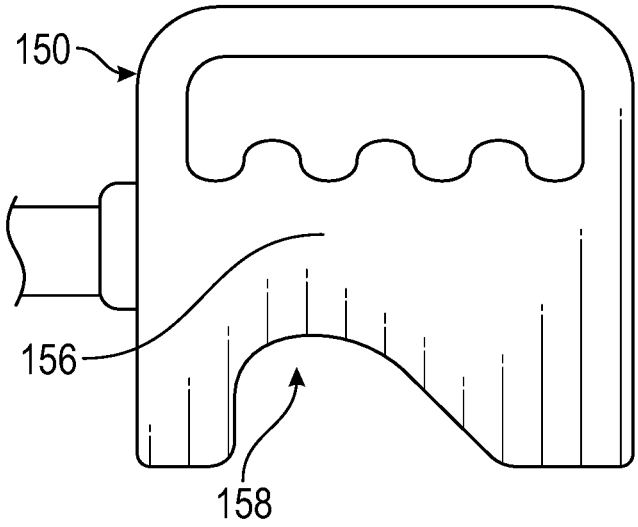
FIGS. 20A-20D are schematic views of alternatives pedals or grips.
Figure 20B:
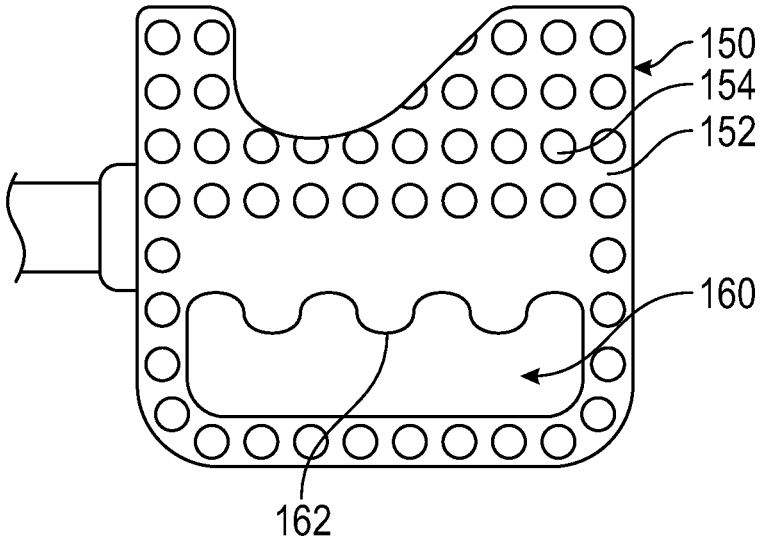
Figure 20C:
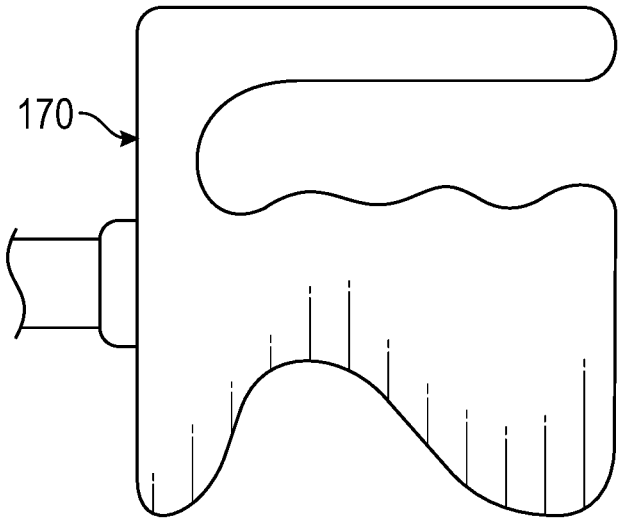
Figure 20D:
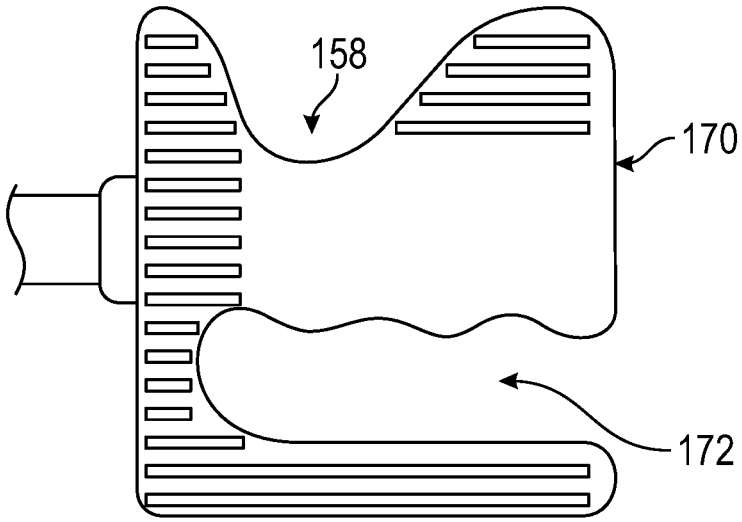
Figure 21:
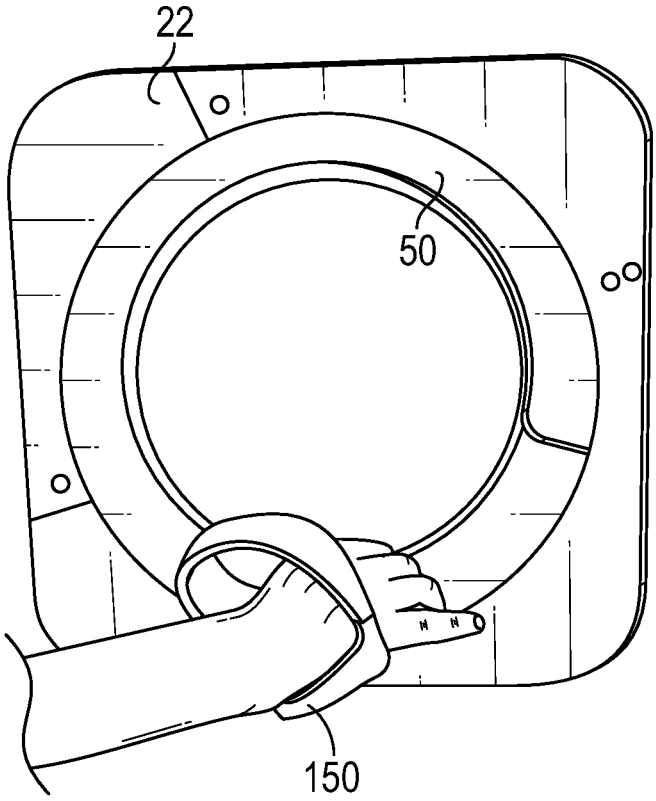
FIG. 21 is a schematic view of pedaling the apparatus using the hands instead of the feet.

FIG. 19 shows a user pedaling the apparatus 20 using the legs and feet. As shown in FIG. 21 a user may alternatively pedal the apparatus 20 using the arms and hands. The pedals 50 may be replaced by pedal grips 150 adapted to be used with hands or feet, or only the hands. Hence, as used here, reference to a pedal refers as well to a pedal grip. FIGS. 20A and 20B show a pedal grip 150 having a first side 152 having projections or ridges 154 for use with the feet and a smooth second side 156 for use with the hands. The user flips the pedal grip 150 over to select the desired side for use. The pedal grip 150 has a curved thumb recess 158 and a fingers opening 160, optionally including finger grooves 162. FIGS. 20C and 20D show an alternative pedal grip 170 having a fingers slot 172 instead of the fingers opening 160 shown in FIGS. 20A and 20B.

The specific details of particular embodiments may be combined in any suitable manner without departing from the spirit and scope of embodiments of the invention. However, other embodiments of the invention may be directed to specific embodiments relating to each individual aspect, or specific combinations of these individual aspects.

The above description of example embodiments of the invention has been presented for the purposes of illustration and description. It is not intended to be exhaustive or to limit the invention to the precise form described, and many modifications and variations are possible in light of the teaching above.

In the preceding description, for the purposes of explanation, numerous details have been set forth in order to provide an understanding of various embodiments of the present technology. It will be apparent to one skilled in the art, however, that certain embodiments may be practiced without some of these details, or with additional details.

Having described several embodiments, it will be recognized by those of skill in the art that various modifications, alternative constructions, and equivalents may be used without departing from the spirit of the invention. Additionally, a number of well-known processes and elements have not been described in order to avoid unnecessarily obscuring the present invention. Additionally, details of any specific embodiment may not always be present in variations of that embodiment or may be added to other embodiments.

Where a range of values is provided, it is understood that each intervening value, to the tenth of the unit of the lower limit unless the context clearly dictates otherwise, between the upper and lower limits of that range is also specifically disclosed. Each smaller range between any stated value or intervening value in a stated range and any other stated or intervening value in that stated range is encompassed. The upper and lower limits of these smaller ranges may independently be included or excluded in the range, and each range where either, neither, or both limits are included in the smaller ranges is also encompassed within the invention, subject to any specifically excluded limit in the stated range. Where the stated range includes one or both of the limits, ranges excluding either or both of those included limits are also included.

As used herein and in the appended claims, the singular forms "a", "an", and "the" include plural referents unless the context clearly dictates otherwise. Thus, for example, reference to "a method" includes a plurality of such methods and reference to "the membrane" includes reference to one or more membranes and equivalents thereof known to those skilled in the art, and so forth. The invention has now been described in detail for the purposes of clarity and understanding. However, it will be appreciated that certain changes and modifications may be practice within the scope of the appended claims.

The invention claimed is:

1. An exercise apparatus, comprising:

a frame;

a ring rotatably supported within the frame, the ring encircling an open center space;

a first pedal on a first pedal shaft, and a second pedal on a second pedal shaft, the first pedal shaft and the second pedal shaft pivotally attached to the ring, the first pedal shaft pivotal from a folded position wherein the first pedal shaft is on a first radius of the ring, to a deployed position wherein the first pedal shaft is perpendicular to a plane of the ring;

a first pedal lock out for maintaining the first pedal in the deployed position;

the second pedal shaft pivotal from a folded position wherein the second pedal shaft is on a second radius of the ring, to a deployed position wherein the second pedal shaft is perpendicular to the plane of the ring; and a second pedal lock out for maintaining the second pedal in the deployed position.

2. The exercise apparatus of claim 1 wherein the first pedal lockout includes a first spring for holding the first pedal shaft into a first side opening in the ring, and the second pedal lockout includes a second spring for holding the second pedal shaft into a second side opening in the ring, the first and second springs acting in a direction tangent to the ring.

3. The exercise apparatus of claim 2 wherein the first side opening extends into a first radial opening in the ring, and the second side opening extends into a second radial opening in the ring.

4. The exercise apparatus of claim 1 wherein the apparatus has no central hub or axle, and no seat.

5. The exercise apparatus of claim 1 wherein the pedals are entirely within an envelope of the frame, when the pedals are in the folded position.

6. The exercise apparatus of claim 1 further comprising first and second legs attached to a front of the frame at a vertical position above a lower end of the ring, each leg pivotable outwardly and downwardly in an arc, for holding the front of the frame in an upright position.

7. The exercise apparatus of claim 1 wherein the ring has inner diameter of 18 to 28 cm and the pedals are spaced apart by 3-20 mm when in the folded position.

8. The exercise apparatus of claim 1 further including a grip element on a flat bottom surface of the frame, the grip element comprising a textured surface, an adhesive surface, rubber feet and/or hook and loop material.

9. The exercise apparatus of claim 1 further including first and second legs pivotally attached to the frame, each leg and the ring having a radius of curvature with a common center.

10. The exercise apparatus of claim 1 wherein each pedal shaft is rigidly attached to a pivot axle in the ring, and a spring associated with each pivot axle exerts a force on that pivot axle in a direction tangent to the ring.

11. An exercise apparatus, comprising:

a frame;

an annular ring rotatably supported within the frame;

first and second pedals, each pedal attached to a pedal shaft, and each pedal shaft pivotally attached to the ring to allow each pedal to pivot from a folded position to a deployed position; and each pedal having a lock out including a side opening in the ring, for maintaining the pedal in the deployed position.

12. The exercise apparatus of claim 11 wherein each pedal has a groove adapted to snap onto the ring.

13. The exercise apparatus of claim 11 wherein each pedal is rotatably attached to a pedal shaft, each pedal shaft is rigidly attached to a pivot axle in the ring, and each pivot axle is pushed by a spring.

14. The exercise apparatus of claim 11 further comprising first and second legs pivotally attached to first and second sides of the frame, the first and second legs each pivotal outward and downward in an arc from a folded position, wherein at least outer ends of the first and second legs are received in first and second recesses, respectively, to an unfolded position wherein the outer ends of the first and second legs are flush with, or extend beyond, a bottom surface of the frame.

15. The exercise apparatus of claim 11 further including first and second legs pivotally attached to the frame, each leg and the ring having a radius of curvature with a common center.

16. The exercise apparatus of claim 11 wherein each pedal lockout includes a spring urging one of the pedal shafts into one of the side openings, wherein the springs act in a direction tangent to the ring.

17. The exercise apparatus of claim 11 further comprising an adjustable pedaling resistance device having a strap extending partially around an outside surface of the ring.

18. The exercise apparatus of claim 11 further comprising an adjustable pedaling resistance device having first and second lever arms moving first and second brake pads to press against a fin on a rim.

19. An exercise apparatus, comprising:

an annular ring supported within a frame;

first and second pedals, each pedal attached to a pedal shaft, and each pedal shaft pivotally secured to the ring, each pedal pivotal from a folded position wherein the pedal shaft extends through a radial opening of a slot in the ring to a deployed position wherein the pedal shaft extends through a side opening of the slot and the pedal shaft is perpendicular to the ring;

wherein each pedal shaft is rigidly attached to a pivot axle in the ring, and first and second springs exert spring force, respectively, on the pivot axles.

20. The exercise apparatus of claim 19 wherein the spring force pushes the pivot axle in a direction tangent to the ring.

* * * * *